US007905181B2

(12) United States Patent
Ciesiun et al.

(10) Patent No.: US 7,905,181 B2
(45) Date of Patent: Mar. 15, 2011

(54) BIOLUMINESCENT PAINTBALL

(76) Inventors: Paul M. Ciesiun, Joliet, IL (US); Ronnie Bayless, Plant City, FL (US)

( * ) Notice: Subject to any disclaimer, the term of this patent is extended or adjusted under 35 U.S.C. 154(b) by 610 days.

(21) Appl. No.: 11/974,623

(22) Filed: Oct. 15, 2007

(65) Prior Publication Data

US 2008/0035006 A1 Feb. 14, 2008

Related U.S. Application Data

(63) Continuation-in-part of application No. 11/051,647, filed on Feb. 5, 2005, now abandoned.

(51) Int. Cl.
*F42B 12/40* (2006.01)

(52) U.S. Cl. ..... 102/513; 102/502; 362/34

(58) Field of Classification Search ..... 102/513, 102/498, 502, 501; 362/34; 206/219
See application file for complete search history.

(56) References Cited

U.S. PATENT DOCUMENTS

| | | | | |
|---|---|---|---|---|
| 2,318,718 | A | 12/1939 | Scherer | |
| 3,774,022 | A | 11/1973 | Dubrow | |
| 3,940,605 | A | 2/1976 | Gerber | |
| 5,001,880 | A | 3/1991 | Smith | |
| 5,004,614 | A * | 4/1991 | Staniforth | 424/466 |
| 5,018,450 | A | 5/1991 | Smith | |
| 5,254,379 | A | 10/1993 | Kotsiopoulos et al. | |
| 5,448,951 | A | 9/1995 | Olson | |
| 5,762,058 | A | 6/1998 | Cheng | |
| 6,210,709 | B1 | 4/2001 | Laba et al. | |
| 6,223,658 | B1 * | 5/2001 | Rosa et al. | 102/501 |
| 6,298,841 | B1 | 10/2001 | Cheng | |
| 6,375,981 | B1 | 4/2002 | Gilleland et al. | |
| 6,393,992 | B1 * | 5/2002 | Vasel et al. | 102/502 |
| 6,532,947 | B1 * | 3/2003 | Rosa et al. | 124/56 |
| 6,543,365 | B1 * | 4/2003 | Vasel et al. | 102/502 |
| 6,546,874 | B2 * | 4/2003 | Vasel et al. | 102/444 |
| 6,615,739 | B2 | 9/2003 | Gibson | |
| 6,949,256 | B2 | 9/2005 | Fonkwe et al. | |
| 7,017,497 | B1 | 3/2006 | Gardner, Jr. | |
| 7,194,960 | B2 * | 3/2007 | Vasel et al. | 102/502 |

(Continued)

FOREIGN PATENT DOCUMENTS

JP 11304676 A 11/1999

*Primary Examiner* — Benjamin P Lee
(74) *Attorney, Agent, or Firm* — Cherskov & Flaynik

(57) ABSTRACT

A Bioluminescent Paintball 10 includes a shell 12 defining an interior cavity 14, a liquefied substance 16 disposed within the interior cavity 14, a phosphorescent material 18 disbursed throughout the shell 12 for providing a visible "tracing" effect when the bioluminescent paintball 10 is ejected from a paintball discharge device, a neutralizing agent 20 disbursed throughout the liquefied substance 16 for neutralizing calcium disbursed throughout the liquefied substance 16 thereby preventing light emission before the paintball 10 impacts a target, and a photoprotein 22 disbursed throughout the liquefied substance 16 for reacting with calcium disposed upon a target after the bioluminescent paintball 10 impacts the target, thereby rupturing the shell 12 and allowing the liquefied substance 16 to engage the calcium to produce visible light. A paintball 100 includes a shell 102 defining an interior cavity 104, an insoluble coating 106 disposed upon an inner surface 108 of the shell 102, and an aqueous material 110 disposed within the cavity 104 such that the aqueous material 110 engages the insoluble coating 106, thereby preventing the aqueous material 110 from dissolving the shell 102, and promoting the marking of a target via the aqueous material 110 when the paintball 100 forcibly engages the target and ruptures the shell 102.

25 Claims, 2 Drawing Sheets

U.S. PATENT DOCUMENTS

| | | | | |
|---|---|---|---|---|
| 2002/0112640 | A1 | 8/2002 | Brown | |
| 2002/0129728 | A1* | 9/2002 | Vasel et al. | 102/502 |
| 2002/0134055 | A1 | 9/2002 | Martinez, Jr. | |
| 2002/0134274 | A1 | 9/2002 | Martinez, Jr. | |
| 2003/0047105 | A1* | 3/2003 | Vasel et al. | 102/502 |
| 2004/0072708 | A1* | 4/2004 | Duffield et al. | 510/293 |
| 2004/0234761 | A1 | 11/2004 | Hausmanns et al. | |
| 2005/0106233 | A1 | 5/2005 | Andersen et al. | |
| 2005/0266114 | A1 | 12/2005 | Meidenbauer | |
| 2006/0005732 | A1 | 1/2006 | Forster | |
| 2006/0011089 | A1 | 1/2006 | Hensel | |
| 2006/0016361 | A1 | 1/2006 | Bland | |
| 2006/0205546 | A1 | 9/2006 | Liu et al. | |
| 2006/0288898 | A1 | 12/2006 | Byun | |
| 2007/0054762 | A1 | 3/2007 | Tocco | |
| 2007/0079722 | A1 | 4/2007 | Parish | |
| 2007/0148380 | A1 | 6/2007 | Black | |
| 2008/0134927 | A1 | 6/2008 | Skellern | |
| 2008/0163779 | A1 | 7/2008 | Campo | |
| 2008/0217812 | A1 | 9/2008 | Perrone | |

* cited by examiner

BIOLUMINESCENT PAINTBALL

This is a Continuation-In-Part Application of application Ser. No. 11/051,647 filed on Feb. 5, 2005 now abandoned.

BACKGROUND OF THE INVENTION

1. Filed of the Invention

This invention relates to a luminescent projectile used during night time paintball play or night time training exercises by military or police forces by which "tracer" and "marking" projectiles are utilized in low light or dark conditions. The "tracer" effect serves as entertainment or a visual reference for a line of fire, which allows for corrections and adjustments to be made. Further, in daytime paintball games or in military and police exercises, the visible "marking" of a target by the contents of a projectile generally designates elimination from play or participation.

This invention also relates to a paintball fabricated from an aqueous or water based material, rather than a hydrocarbon or glycerin and/or glycol based material. The tracer effect may be included with a water based paintball by adding a phosphorescent material to the aqueous material and/or to material that forms a shell portion of the paintball.

Further, this invention relates to a water based capsule for products regulated by the U.S. Food and Drug Administration.

2. Background of the Prior Art

The use of Luminescent paintballs is known in the prior art. The prior art includes U.S. Pat. Nos. 5,018,450; 3,774,022; 3,940,605; 4,706,568; 5,762,058; Des. 264,364; and 6,298,841.

The problem with prior art luminescent paintballs is that the effective brilliance and duration of visible light emitted from the phosphorescent material in the paintball, is a function of the intensity and duration of exposure of the phosphorescent material to ultraviolet (UV) light. More specifically, the phosphorescent material in a liquefied material in an inner portion of the paintball, receives less UV light than an outer shell portion resulting in reduced visible light being emitted from the phosphorescent material of the inner portion of the luminescent paintball; but because there is a larger quantity of phosphorescent material in the inner portion than in the outer shell, the magnitude of emitted visible light from the inner portion is comparable to the magnitude of emitted visible light from the outer shell.

After the luminescent paintball is discharged from a paintball "gun," the emitted visible light (and the tracing effect) from the projected paintball begins to decay. Prior art luminescent paintballs having phosphorescent material in both the outer and inner portions provide an adequate tracing effect after being discharged from a paintball "gun." Prior art luminescent paintball having phosphorescent material in only the inner portion or only in the outer portion, provide an inadequate tracing effect after being discharged from a paintball gun.

Further, only the phosphorescent material of the inner portion marks or identifies a target struck during a nighttime luminescent paintball episode, because the outer shell ruptures and falls to the ground upon impacting the target. Should the phosphorescent material of the inner portion receive insufficient UV exposure or should the required marking time of the target be beyond the luminescent capabilities of the phosphorescent material, the luminescent paintball will correspondingly fail to identify a struck target thereby failing to promote the nighttime paintball episode.

A need exists for a glow in the dark paintball that provides a tracing effect when discharged from a paintball gun, and that provides a lasting marking feature when the paintball strikes a target. The tracing effect is provided by a phosphorescent material in only an outer shell of the paintball being exposed to UV light. The marking effect is provided by a light generating material in the inner portion of the paintball that does not require a UV light source, instead, the light generating material emits light due to a chemical reaction rather than by exposure to a UV light.

The use of hydrocarbons or oils such as glycol and glycerin for fabricating paintballs used during daylight or nighttime (by adding a phosphorescent material) hours is well known in the art. The problem with oil based paintballs using glycol and/or glycerin is that the paintball is relatively expensive to manufacture, especially with current oil prices constantly increasing. Further, oil based paintballs are not biodegradable, are difficult to wash from target surfaces, and remain on non-targeted surfaces such as trees and buildings for relatively long time periods.

A need exists for day and night paintballs that are relatively inexpensive, biodegradable and that use a paint that is relatively easy to remove from target and non-target surfaces.

Further, a need exists for applying the technology for fabricating the shells of paintballs to capsules of pharmaceutical "pills." More specifically, pharmaceutical capsules include polyethylene glycol as a "fill" material. Utilizing a water based fill material in the capsule, reduces the cost of fabrication and provides an aqueous filler to deliver medication via a capsule, which is ingested and provides a new method for the administration of drugs.

SUMMARY OF THE INVENTION

It is an object of the present invention to overcome many of the disadvantages associated with luminescent paintballs. Further, it is an object of the present invention to incorporate many of the features of the prior art luminescent paintball which include but are not limited to paintball configuration, fabrication materials, paints and filler materials (glycols and glycerins).

A principal object of the present invention is to provide a bioluminescent paintball that can be utilized for allowing paintball games to be played in daylight, low light or dark conditions utilizing nighttime glow and a variance of colors that would allow for vast market distribution. A feature of the bioluminescent paintball is a phosphorescent material disposed in an outer shell. Another feature is a calcium neutralizing agent and a photoprotein disbursed within a liquefied substance disposed in an inner cavity of the bioluminescent paintball, the photoprotein providing visual light when combined with calcium, the neutralizing agent preventing the production of light should calcium be present in the paintball. An advantage of the bioluminescent paintball is that the paintball provides a tracing effect upon being projected from a paintball gun, and provides a visual light marking effect and paint mark upon a target after the bioluminescent paintball impacts the target and ruptures the outer shell to allow the liquefied substance to engage calcium on the target to produce visible light.

Another object of the present invention is to provide an alternative bioluminescent paintball that can be utilized in daylight, low light or dark conditions. A feature of the alternative bioluminescent paintball is a phosphorescent material disposed in an outer shell. Another feature is a first liquefied substance and an inner shell disposed within the outer shell, the first liquefied substance includes a protein disbursed therein. Yet another feature is a second liquefied substance disposed within the inner shell, the second liquefied substance includes an enzyme disbursed therein. An advantage of the alternative bioluminescent paintball is that the paintball provides a tracing effect when rejected from a paintball discharge device. Another advantage of the alternative bioluminescent paintball is that the paintball provides a visual light marking effect and paint mark upon a target after the paintball impacts the target, thereby rupturing the outer and inner shells and allowing the first and second liquefied substances in the shells to flow together to produce light to mark the target. This alternative bioluminescent paintball provides light without requiring the presence of calcium on the target, but the alternative paintball is more expensive to manufacture than the calcium reactive paintball.

Still another object of the present invention is to provide another alternative bioluminescent paintball that provides visible light without the presence of calcium on the target. A feature of the alternative paintball is a phosphorescent material disposed in an outer shell. Another feature of the alternative paintball is an inner wall inside the outer shell, the inner wall forming a first inner cavity containing a first liquid substance with an enzyme disbursed therein, and a second inner cavity containing a second liquid substance with a protein disbursed therein. An advantage of this alternative paintball is that the paintball provides a tracing effect when projected from a paintball discharge device. Another advantage of this alternative paintball is that the internal configuration promotes stability during flight and reduces the "bursting force" required to combine the enzyme and protein.

This alternative paintball requires the rupturing of only an inner wall upon target impact to provide visible light. The above alternative bioluminescent paintball requires the rupturing of an outer shell and an inner shell. The utilization of thixotropic thickeners to create an aqueous gel, allows the inner capsule to be stabilized and centrally located, thereby promoting an accurate flight projection of this alternate paintball.

Yet another object of the present invention is to provide paintballs (for day or night use) that are fabricated from water based or aqueous material instead of an oil based material. A feature of the water based paintballs is a soluble polymer shell. Another feature of the water based paintballs is an insoluble coating on an inner wall of the shell. An advantage of the water based paintballs is that the shell biodegrades relatively fast. Another advantage of the water based paintballs is that the shell will not degrade or dissolve when a water based or aqueous material is disposed within a cavity defined by the shell, due to the aqueous material engaging only the insoluble coating. Another object of the present invention is to provide water based paintballs that do not harm landscape exposed to paintball activity. A feature of the water based paintballs is neutralizing agent added to the aqueous material. An advantage of the water based paintballs is that the ph level of the aqueous material is substantially equal to the ph level of water (i.e. 7.0). Another advantage of the water based paintballs is that the aqueous material biodegrades relatively fast.

Another object of the present invention is to provide water based paintballs that are relatively easy and inexpensive to fabricate. A feature of the water based paintballs is an aqueous material that is substantially a gel when inactive and substantially a liquid when active. An advantage of the water based paintballs is that when the aqueous material is an inactive gel state, the aqueous material is relatively easy to encase in the insoluble coating and soluble shell. Another advantage of the water based paintball is that when the paintball is forcibly urged toward a target, the aqueous material is in an active liquid state that promotes the dispersing of the aqueous material (and pigments suspended in the aqueous material) upon a target surface to indicate a "hit" by a paintball participant.

Another object of the present invention is to provide a water based capsule for products regulated by the U.S. Food and Drug Administration. A feature of the water based capsule is a capsule fill material combined with a medication. An advantage of the water based capsule is that cost is reduced and the capsule fill (water) is readily absorbed by the body.

Briefly, the invention provides a bioluminescent paintball comprising a shell defining an interior cavity; a liquefied substance disposed within said cavity; a phosphorescent material disposed within said shell, said phosphorescent material providing a tracer effect when said bioluminescent paintball is ejected from a paintball discharge device; a neutralizing agent disbursed within said liquefied substance; and a photoprotein disbursed within said liquefied substance, said photoprotein producing visible light when combined with an ion such as calcium on a target after said bioluminescent paintball impacts the target thereby rupturing said shell and allowing said liquefied substance to engage the target.

The invention further provides a bioluminescent paintball comprising an outer shell defining a first interior cavity; a first liquefied substance disposed within said first interior cavity; an inner shell disposed within said first interior cavity, said inner shell defining a second interior cavity; a second liquefied substance disposed within said second interior cavity; a phosphorescent material disposed within said outer shell, said phosphorescent material providing a tracer effect when said bioluminescent paintball is ejected from a paintball discharge device; a protein disbursed within said first liquefied substance in said first interior cavity; an enzyme disbursed within said second liquefied substance in said second interior cavity, said enzyme and protein producing visible light when combined after said bioluminescent paintball impacts a target thereby rupturing said outer and inner shells and allowing said first and second liquefied substances in said first and second interior cavities to flow together to produce light to mark the target.

The invention further provides a bioluminescent paintball comprising an outer shell defining first and second inner cavities separated by an inner wall; a first liquid substance disposed within said first inner cavity; a second liquid substance disposed within said second inner cavity; a phosphorescent material disposed within said outer shell, said phosphorescent material providing a tracer effect when said bioluminescent paintball is ejected from a paintball discharge device; an enzyme disbursed within said first liquid substance in said first interior cavity; a protein disbursed within said second liquid substance in said second interior cavity, said enzyme and protein producing visible light when combined after said bioluminescent paintball impacts a target thereby rupturing said outer shell and said inner wall and allowing said first and second liquid substances in said first and second inner cavities to flow together to produce light to mark the target.

The invention further provides a paintball comprising a soluble shell defining an interior cavity; an insoluble coating disposed upon an inner surface of said shell; and an aqueous material disposed within said cavity, said aqueous material engaging said insoluble coating disposed upon said inner surface of said shell, whereby said aqueous material is prevented from dissolving said shell thereby promoting the marking of a target via said aqueous material when said paintball forcibly engages the target and ruptures said shell.

The invention further provides a method for fabricating paintballs, said method comprising the steps of fabricating a plurality of relatively rigid half-shells with central recesses; disposing an aqueous material in said recesses of said half-shells; allowing said aqueous material to gel; joining two of said half-shells with said gelled aqueous material disposed in said central recesses; and sealing said joined half-shells, whereby a paintball is fabricated that ultimately engages a target, whereupon, said half-shells rupture thereby promoting the engagement of a now substantially liquid aqueous material upon the target.

The invention further provides a method for fabricating paintballs, said method comprising the steps of fabricating a plurality of relatively rigid gel spheres of aqueous fill material; coating, dipping or spraying said aqueous material spheres with an insoluble material; and forming a shell about said coated aqueous spheres, whereby a spherical paintball is fabricated that ultimately engages a target, whereupon, said shell ruptures thereby promoting the engagement of a now substantially liquid aqueous material upon the target.

Soluble outer shell materials, such as gelatin, may be used if an insoluble coating is applied to the inner surface of the outer shell wall. This coating shall act as a barrier between the aqueous fill and outer soluble shell.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
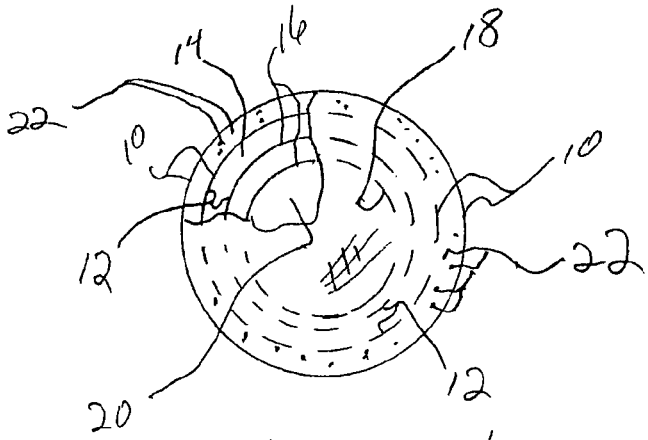
FIG. 1 is a front elevation, partial phantom-partial cutaway view of a bioluminescent paintball having light generating protein and enzyme substances in separate inner cavities in accordance with the present invention.

Referring now to the drawings and in particular to FIG. 1, a bioluminescent paintball in accordance with the present invention is denoted by numeral 8. The bioluminescent paintball 8 includes a breakable solid spherical outer shell 10 constructed of two hemispheres fused together to create an interior chamber or cavity 12 containing a first liquefied substance 14. The paintball 8 further includes an inner breakable solid spherical shell 16 disposed inside the outer shell 10 and in the first liquefied substance 14. The inner shell 16 defines a second interior cavity 18 containing a second liquefied substance 20. A phosphorescent material or glow powder 22 is disposed within the outer shell 10. A light emitting paintball requires an aqueous gel with a pH ranging from 7.0 to 8.0 or similar water based filler comprising the first liquefied substance 14. Also included in the liquefied substance 14 is a luciferase or protein, a calcium-neutralizing agent such as EDTA, and dyes, paints or colorants of white or similar bright colors. Coelenterazine or CTZ (luciferin) or similar enzyme is disbursed within the second liquefied substance 20, which is purged of air bubbles and air pockets and may contain fillers such as propylene glycol. The proteins and enzymes are disclosed in U.S. Pat. Nos. 6,232,107 and 6,436,682 belonging to Prolume Ltd. of PO Box 2746 Pinetop, Ariz. 85935 and Bruce J. Bryan of Beverly Hills, Calif. 90210.

The inner spherical shell 16 is approximately ⅔ the size of the outer shell 10. The inner macro or micro encapsulated sphere may be produced but is not limited to materials such as plastics, gelatins, waxes, or synthetic polymers. An inner sphere would be free from defects and could be manufactured in a process of seamless encapsulation. Special machines such as the Globex Mark III Capsulator are utilized in the manufacture of capsules in this manner and are manufactured by a company such as ITS Machinery Development.

The outer shell 10 may be comprised of insoluble materials such as plastics, waxes and hardeners such as carnauba, candelilla, bees, paraffin, stearic acid, synthetic polymers, polyesters, polylactic acid, starch copolymers, high molecular weight polyvinylalcohol, unstabalized polyethelyne, unstabilized polypropylene, polystyrene, and combinations thereof. The outer shell 10 may also consist mainly of gelatin, so long as an inner spherical wall 24 in contact with the first liquefied substance 14 is coated, treated, or filmed with an insoluble barrier constructed from waxes, proteins, synthetic polymers or natural polymers such as Chitosan, an amorphous polymer of deacylated chitin. This insoluble barrier allows for conventional gelatin materials to be used while encapsulating usually non-compatible materials within the gelatin shell. In this embodiment it is intended that when the paintball is projected at sufficient force that both the outer and inner shells 10 and 16 fracture and expel respective first and second liquefied substances 14 and 20 causing a mixture and subsequent chemical reaction. Luciferase catalyzes the oxidation of the Coelentrazine or Luciferin, this results in a reaction causing light and resulting in an inactive Oxyluciferin.

Luciferin and Luciferase may also be bound to a cofactor such as oxygen (O2) in order to create a single photoprotein, or a molecule, which is reactive with ions such as Calcium (Ca2++) in order to facilitate an ion exchange and chemical reaction, which produces visible light. This configuration of compounds in fact comprises the preferred embodiment of the invention.

Figure 2:
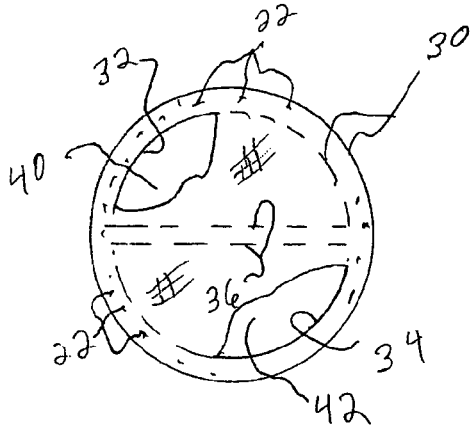
FIG. 2 is a front elevation, partial phantom-partial cutaway view of the bioluminescent paintball of FIG. 1 but with an alternative design for the inner cavities in accordance with the present invention.

Referring now to FIG. 2, an alternative embodiment 29 in accordance with the present invention is depicted. The alternative embodiment 29 includes a breakable solid spherical outer shell 30 formed from two hemispheres fused together to define first and second inner cavities 32 and 34 separated by an inner wall 36. The outer shell 30 is insoluble and may include a phosphorescent material 22 disposed within the shell 30, a first liquid substance 40 disposed in the first inner cavity 32, and a second liquid substance 42 disposed in the second inner cavity 34. Coelentrazine (Luciferin) or similar enzyme is disbursed within the first liquid substance 40, which is purged of air bubbles and air pockets. A light emitting paintball requires an aqueous material with a pH ranging from 7.0 and 8.0 disbursed within the second liquid substance 42. Also included in the second liquid substance 42 is a Luciferase or protein, and dyes, paints or colorants.

The phosphorescent material 22 glows in the dark after being exposed to a light for a period of time and said liquefied substance and subsequent dyes providing a reflective background in order to increase the brilliance and duration of the glowing phosphors. Further a light with a higher concentrate of Ultraviolet (UV) light, generally increases the potential for energy absorption on a smaller timeline, and increases overall duration and brilliance of a nighttime glow. The phosphorescent materials may be comprised of a multitude of powders loaded at up to 10% by weight into the outer spherical shell. The phosphors may consist of Aluminum, Europium, Strontium, Iridium or Boron Oxides which provide a wide array of colors including but not limited to Orange, Green, Yellow, Blue, Purple, Red, Red-Orange, Blue-Green and Aqua. Said phosphors being constructed by Hirotec, Inc. of Santa Ana, Calif. and Nichia America of Mountville, Pa.

Figure 3:
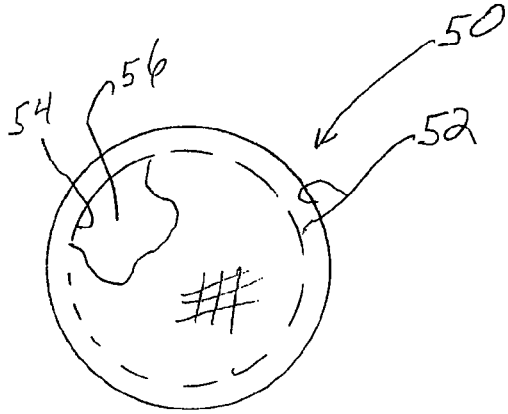
FIG. 3 is a front elevation, partial phantom-partial cutaway view of a bioluminescent paintball having one cavity with an ion reactive photoprotein substance disbursed therein in accordance with the present invention.

Referring now to FIG. 3, a third and preferred embodiment 50 in accordance with the present invention is depicted. The preferred embodiment includes a homogenous liquefied mixture 56 having ions such as Calcium (Ca2++) neutralized by a calcium neutralizing agent such as EDTA, a photoprotein (bound Luciferin and Luciferase by a cofactor such as Oxygen) a single ion reactive compound added to the liquefied substance, renders the entire mixture "reactive" in that when in contact with an ion a chemical reaction occurs which generates visible light. Thus, when the liquefied substance is expelled from a fractured paintball upon a target containing an ion, most notably calcium, the liquefied substance yields a bright visible "glow", which is satisfactory to identify a "mark" or strike on a target in low light or dark conditions.

In a preferred embodiment 50 of the present invention, a water insoluble phosphor comprised mainly of such as those manufactured by Nichia America. Phosphors can include but are not limited to the following chemical composition and product number:

Blue-green $Sr_4Al_{14}O_{25}$:Eu,Dy (Nichia product NP-2820)
Reddish-Orange $Y_2O_2S$:Eu,Mg,Ti (Nichia product NP-2850)
Green $SrAl_2O_4$:Eu,Dy (Nichia product NP-2830)

Additionally in the preferred embodiment 50 of the present invention, a photoprotein (a single reactive compound), and ion neutralizer most notably a calcium neutralizer, are disposed in the liquefied substance 56 of an inner cavity 54 created by an outer breakable solid spherical shell 52 comprised of two fused hemispheres and of which can be comprised of gelatins, plasticizers, waxes, synthetic polymers, polyesters, polylactic acid, starch copolymers, high molecular weight polyvinylalcohol, unstabalized polyethelyne, unstabilized polypropylene, polystyrene, and combinations thereof. The internal surface would come into contact with the aqueous liquefied substance but for the presence of hydrophobic barrier, which may consist of proteins, chitin, waxes, or ethylcellulose. This creates an insoluble barrier between the inner surface of the outer soluble shell and the aqueous liquefied substance. Therefore, creating a homogenous mixture that will ultimately generate visible light after said paintball fractures against a selected target.

A fourth embodiment (not depicted) in accordance with the present invention, is the introduction of a water insoluble phosphor into a water filler material which is perfectly clear and is encased in an outer shell which is also transparent or translucent. This embodiment provides an environment that contains a new water based filler material and to which a unique phosphor may be added in order to generate a tracing and marking effect. With the use of water based filler materials, a completely clear filler may be used to reduce the amount of phosphors and reduce the overall cost of the product.

The photoprotein of the preferred embodiment 50 allows for the generation of sufficient light regardless of overall impact area to effectively mark a target in low light or dark conditions. As with photo-storage materials and the use of surfactants to suspend these materials the more dispersion of an impact, the less concentration of energized phosphors and therefore less brilliance and effectiveness. In this preferred embodiment of the invention, the photoprotein is dissolved within the liquefied substance prior to encapsulation at a load ratio sufficient to render the entire liquefied substance ion reactive. This should be approximately 0.5-1% load by weight of a 3.5 g paintball.

Referring back to FIG. 3, the depicted bioluminescent paintball 50 generally comprises an outer, breakable, solid spherical shell 52 fabricated of insoluble material, or utilizes an insoluble barrier and soluble materials such as gelatin. The outer shell 52 defines an interior cavity 54 having a liquefied substance 56 disposed therein, a phosphorescent material 22 disposed within the shell 52, the phosphorescent material providing a tracer effect when the bioluminescent paintball 50 is ejected from a paintball discharge device, an ion neutralizing agent disbursed within the liquefied substance 56, an ion reactive photoprotein disbursed within the liquefied substance 56, to engage the target. The outer shell 52 may be formed of transparent, translucent or pigmented material so long as the material is constructed from solid materials such as gelatins, plastics, or synthetic or organic polymers, such as polyesters, polylactic acid, starch copolymers, high molecular weight polyvinylalcohol, unstabalized polyethelyne, unstabilized polypropylene, polystyrene, and combinations thereof, which are capable of withstanding forcible projection. The outer shell 52 must also be capable of fracturing upon engaging a participant without injuring that individual.

The liquefied substance 56 disposed within the spherical shell 52 may include but is not limited to, water, polyethylene glycols, waxes, surfactants, oils, gelatins, glycerin, and thickening agents such as fumed silica and sorbitol, but the liquefied substance 56 is composed mostly of water. The liquefied substance 56 may be dyed, opaque, or may be a translucent or transparent substance.

A phosphorescent material 22 is disposed on or within the outer spherical shell 52 for tracer effects in Ultraviolet, low light or dark conditions. The most preferred phosphors do not include materials that are known to be toxic, and do not include radioactive materials. One highly suitable insoluble phosphor is available from Nichia America Corporation of 3775 Hempland Road, Mountville, Pa. 17554. The Nichia phosphors includes the following materials:

Blue-green $Sr_4Al_{14}O_{25}$:Eu,Dy (Nichia product NP-2820)
Reddish-Orange $Y_2O_2S$:Eu,Mg,Ti (Nichia product NP-2850)
Green $SrAl_2O_4$:Eu,Dy (Nichia product NP-2830)

Another highly suitable phosphor is available under the trade name "PERMAGLOW™ Premium Glow-in-the-Dark colors" from Hirotec Inc. of 16162 Beach Blvd., Suite 306, of Huntington Beach, Calif. 92647. The PERMAGLOW product includes the following materials:

| Material | Notation | Chemical No. | TSCA No. |
|---|---|---|---|
| Aluminum Oxide | Al2O3 | 1-23 | 1344-28-1 |
| Strontium Oxide | SrO | 9-2441 | 1314-11-0 |
| Europium Oxide | Eu2O3 | 1-679 | 1308-96-9 |
| Boron Oxide | B2O3 | 9-2403 | 1303-86-2 |

The phosphorescent material 22 is capable of producing light after being charged with a light energy source for a period of time to achieve the desired tracer effect. The duration of the production of light is directly related to the time of exposure to a light source to achieve the desired duration.

Overall these new phosphorescent materials 22 contain new characteristics capable of providing the new luminescent paintball with a multitude of colors such as blue, green, blue-green, red, reddish-orange, yellow, orange, violet, pink, aqua, chartreuse and any Pantone™ colors which can be manufactured as needed.

The liquefied substance 56 includes an ion-neutralizing agent such as ethelenediaminetetraacetic acid (EDTA). This calcium-neutralizing agent establishes a stable environment for the introduction of an ion reactive protein or photoprotein into the liquefied substance 56. The EDTA is mixed within the liquefied substance 56 prior to encapsulation into the paintball 50.

After the mixture of EDTA or similar ion neutralizing agent into the liquefied substance 56, an ion reactive photoprotein similar to the enzymes in U.S. Pat. Nos. 6,436,682, 6,247,995, 6,232,107, 6,113,886, 6,152,358, 5,876,995 and made by PROLUME LTD, 163 White Mountain, Pinetop Ariz. USA, 85935, is dissolved into the liquefied substance. This photoprotein is capable of reacting with ions such as calcium or objects containing calcium and producing visible light in the chemical reaction, lasting from several seconds up to ten minutes and satisfying the necessary marking effect in a low light or dark environment.

The addition of this photoprotein produces visible light when the liquefied substance 56 disposed in an inner cavity 54 of the paintball 50 engages a target containing an ion such as calcium (Ca2++). More specifically, when the paintball 50 is forcibly ejected from a paintball gun or discharge device to ultimately engage a target, the outer spherical shell 52 of the paintball 50 ruptures, thereby allowing the inner liquefied substance 56 to engage the target and react with the calcium naturally existing upon a target to produce light. This production of light creates a marking effect on the target that lasts for a predetermined period of time and thus satisfying one vital aspect to an effective luminescent paintball.

The employment of the photoprotein allows for the possibility to exclude phosphors 22 from the liquefied substance, while relegating phosphors instead to the outer spherical shell 52. These phosphors may be used in conjunction with a water fill without the concern for dissolution and thus complete ineffectiveness. Further, when excited these phosphors produce a visible light used to generate a tracer effect necessary for the correction of firing and accurate aiming when engaging a target.

The result is a new luminescent paintball 50, which provides a necessary dual system of tracing and marking. This further enhances the possibility to develop a game or exercise program in association with the use of this new invention.

The foregoing description is for purposes of illustration only and is not intended to limit the scope of protection accorded this invention. The scope of protection is to be measured by the following claims, which should be interpreted as broadly as the inventive contribution permits.

Figure 4:
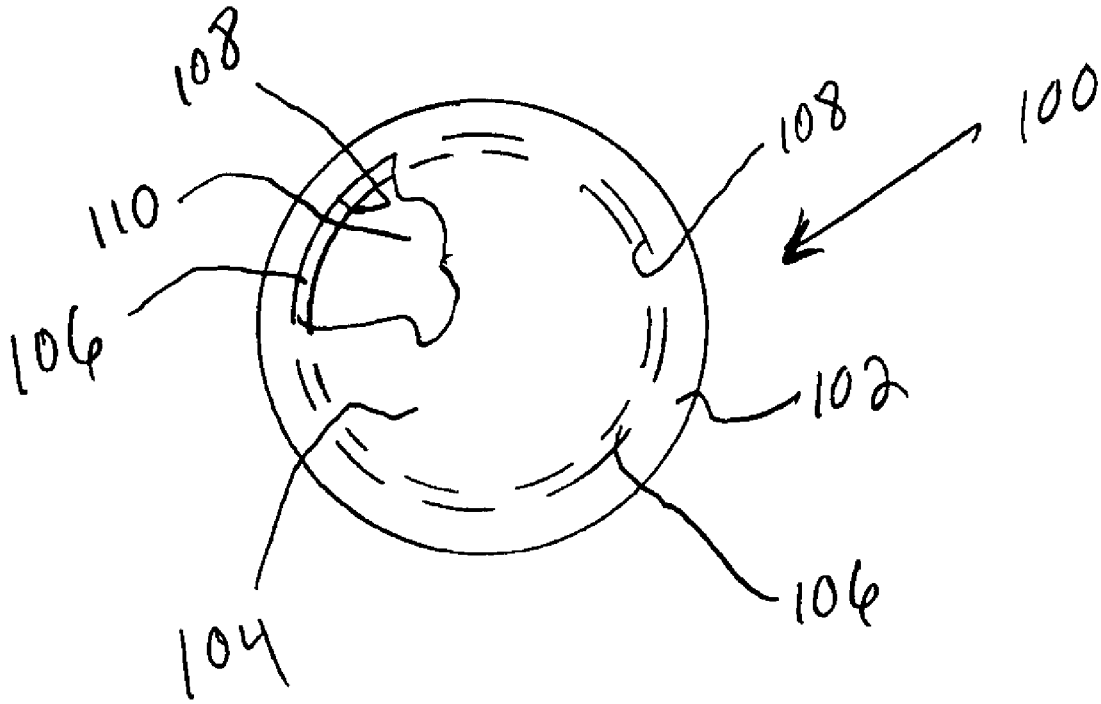
FIG. 4 is a front elevation, partial phantom-partial cutaway view of a water based paintball having a cavity with an aqueous material disbursed therein in accordance with the present invention.

Referring now to FIG. 4, a water based paintball in accordance with the present invention is depicted and denoted as numeral 100. The paintball 100 includes a shell 102 of soluble materials (usually gelatin) defining an interior cavity 104, an insoluble coating 106 disposed upon an inner surface 108 of the shell 102, and a water based or aqueous material 110 disposed and disbursed within the cavity 104 such that the aqueous material 110 engages the insoluble coating 106, thereby preventing the aqueous material 110 from dissolving the shell 102, and promoting the marking of a target via the aqueous material 110 when the paintball 100 is forcibly ejected from a paintball gun (not depicted) ultimately engaging the target causing the shell 102 to rupture and the aqueous material 110 with suspended pigments to disburse upon the target surface.

The shell 102 is fabricated from an extrusion grade biodegradable polymer, extrusion-compounded with inert processing aids and pigments, and extrusion cast into a rolled sheet of dimensions well known to those of ordinary skill in the art. Suitable polymers include, but are not limited to biodegradable polyesters, polylactic acid, starch copolymers and polymer blends, high molecular weight polyvinylalcohol, unstabilized polyethylene, unstabilized polypropylene and polystyrene, and combinations thereof. Coloring pigments may be included in the shell 102. Should the paintball be required for night paintball use, a phosphorescent material may be added to the shell 102, together with a surfactant material to promote the uniform disbursement of the phosphorescent material (or the coloring pigments) throughout the outer shell 102.

The insoluble coating 106 is only necessary when used in conjunction with a soluble outer shell 102. The insoluble coating 106 is a relatively thin layer of a hydrophobic cellulose, including but not limited to ethyl cellulose or similar polymer, an insoluble plasticizer, and fumed silica. The insoluble coating 106 is not suitable to create a projectile that is capable of withstanding projection from an air powered paintball gun. Instead, the insoluble coating 106 performs as an inner shell, which acts as a barrier between the soluble outer shell 102 and the aqueous material 110. The insoluble coating 106 prevents all interaction between the outer shell 102 and the aqueous material 110, thereby allowing the aqueous material 110 to be encapsulated in an otherwise unsuitable outer shell 102.

The aqueous material 110 includes a water content ranging between 1% and 90%, a thixtropic agent, such as Laponite RD, ranging between 1% and 5%, pigments ranging between 1% and 3%, and a neutralizing agent, such as citric acid, in an amount effective to neutralize the mixture to a ph ranging between 7.0 and 8.0, generally 2-3% by weight. The aqueous material 110 is prepared by dispersing the Laponite RD in a portion of the formula water, using a medium to high shear mixer, until a clear material forms. Pigments and ph neutralizer are mixed with the remaining water until a homogenous mixture forms. The colored mixture is then added to the stirring Laponite RD mixture and stirred until homogenous.

The water based paintball 100 is manufactured by first feeding a polymer sheet material onto a heated, horizontal vacuum thermoforming mold. The thermo forming molds contain multiple cavities, in the shape of paintball half-shells. Any caliber of paintballs may be manufactured by adjusting the thermoforming mold cavity geometries to the desired dimensions. By using heated vacuum molds and plug assistance, to ensure uniform shell wall thickness, webs of paintball half-shells are thermoformed. The shell cavities are then filled with the aqueous material 110 using precision metering nozzles so that each cavity is completely filled, level with the top of the web surface. The filling rate and shear of the nozzle is chosen so that the aqueous material 110 thins enough during injection to self-level in the cavities. The aqueous material 110 thereafter forms a gel on standing within a few seconds, and as a gel does not leak out of the half-shells. While the aqueous material 110 is in the gel state, the two filled webs are then turned, either horizontal or vertical, so that the webs oppose each other and the inside surface of the webs are heated to the sealing temperature by use of heated plates or heated air streams. The half-shells are then quickly brought together and compressed with sealing fixtures containing sealing flanges, thus sealing the two filled capsule halves together and forming the paintballs.

Other methods of heating the webs for sealing may be used such as heated molds and ultrasonic welding. Alternatively, the paintball half-shells may be sealed using any suitable adhesive material or sealing methods such as radio frequency sealing. The paintballs 100 are then removed from the webbing by cutting around the outside of the paintball 100 with heated cutting molds or mechanical cutting devices. The resulting paintballs 100 are ready for packaging without further processing.

The paintballs 100 are fabricated in sufficient quantity by preparing a compound having a predetermined biodegradable thermoplastic polymer with the desired pigments; extruding the polymer into rolled sheeting of the desired thickness generally in the range of) 0.005 inches to 0.020 inches; heating and vacuum forming the sheet with the aid of matched metal molds to form "webs" containing paintball rigid half-shells with central recesses formed in the half-shells; coating inner walls of the central recesses with an insoluble material 106, required only when using soluble material to form the outer shell 102; filling the central recesses in the half-shells with a precisely measured amount of aqueous material 110, which contains a thixotropic thickener (Laponite RD) to promote the leveling and gelling of the aqueous material 110 in the half-shells; allowing the aqueous material 110 to gel; joining two half-shells with the gelled aqueous material 110 in the recesses to form a spherical paintball; sealing a seam of the two joined half-shells via heat to melt the polymer shell material, or sealing the seam via adhesives well known to those of ordinary skill in the art; and removing the formed and sealed paintballs from the webbing via "hot knives" or by a mechanical cutting system well know to those of ordinary skill in the art.

An alternative method for fabricating the paintballs 100 includes two congruent sets of molds with selected configurations (usually spherical). The molds are joined together to form multiple cavities with fill apertures to promote access of the aqueous material 110 into each cavity. After each cavity is filled with aqueous material 110, a pin is inserted through the fill aperture and into the internal cavity of the mold. After the liquid aqueous material 110 sets in the mold for a relatively short time period, a thixotropic thickener causes the aqueous material 110 to become a relatively rigid gel that grasps the pin. After the two sets of molds are horizontally disposed and separated, the aqueous gel material 110 is removed from a bottom mold via the pin, then supported by the pin to allow a coating of insoluble material 106 to sprayed upon the entire surface of the gel 110, followed by polymer coating sprayed upon or formed (via dip coating techniques) over the insoluble material 106. The pin is removed after the polymer hardens, and the resulting aperture is sealed with the same polymer. The hardened polymer forms the shell 102 of the water based paintball 100 and promotes the projection of the paintball 100 from an air powered gun. The shell 102 is capable of breaking or rupturing upon a target, whereupon, the activity or energy of the paintball 100 engaging the target causes the aqueous gel material to convert back to a substantially liquid aqueous material and flow upon and mark the target.

The invention claimed is:

1. A paintball comprising:

a first half shell having a central recess;

an aqueous material disposed within said central recess of said first half shell, said aqueous material including a thixotropic thickening agent that promotes a relatively liquid aqueous material when filling said recess, thereby completely filling and self-leveling said aqueous material in said recess without engaging a sealing surface of said first half shell to promote the bonding of said sealing surface, said thixotropic thickening agent ultimately causing said aqueous material to change to a gel that maintains position and configuration in said recess irrespective of the position of said first half shell;

a second half shell having a central recess, said recesses of said first and said second half shells having the same dimensions and configurations, said second half shell being disposed relatively close to but separate from said first half shell; and an aqueous material disposed within said central recess of said second half shell, said aqueous material including a thixotropic thickening agent that promotes a relatively liquid aqueous material when filling said recess in said second half shell, thereby completely filling and self-leveling said aqueous material in said recess in said second half shell without engaging a sealing surface of said second half shell to promote the bonding of said sealing surface, said thixtropic thickening agent ultimately causing said aqueous material to change to a gel that maintains position and configuration in said recess of said second half shell irrespective of the position of said second half shell, said second half shell ultimately being inverted and aligned over said first half shell without providing a barrier to seal said aqueous gel material in said recess of said second half shell, whereby said second half shell is ultimately joined to said first half shell resulting in a paintball that ruptures when forcibly engaging a target, said thixtropic thickening agent allowing said gel to change to a liquid when the paintball forcibly impact the target to promote a relatively free flowing liquid aqueous material upon the target.

2. The paintball of claim 1 wherein said shell includes a polymer.

3. The paintball of claim 2 wherein said polymer shell is biodegradable.

4. The paintball of claim 2 wherein said polymer is selected from the group consisting of polyesters, polylactic acid, starch copolymers, high molecular weight polyvinylalcohol, unstabilized polyethylene, unstabilized polypropylene, polystyrene, and combinations thereof.

5. The paintball of claim 1 wherein said shell includes a pigment material.

6. The paintball of claim 1 wherein said aqueous material disposed within said recesses of said first and second half shells is manually leveled after completely filling said recesses, said aqueous material being leveled such that sealing surfaces of said first and second half shells are not engaged by said aqueous material, thereby promoting the bonding of a sealing surface of said first half shell to a sealing surface of said second half shell.

7. The paintball of claim 1 wherein said aqueous material includes a neutralizing agent.

8. The paintball of claim 7 wherein said neutralizing agent includes citric acid.

9. The paintball of claim 1 wherein said aqueous material includes a pigment material.

10. The paintball of claim 1 wherein said aqueous material includes a surfactant material.

11. The paintball of claim 1 wherein said aqueous material includes a phosphorescent material.

12. The paintball of claim 1 wherein said insoluble coating includes a hydrophobic cellulose.

13. The paintball of claim 1 wherein said shell includes a surfactant material.

14. The paintball of claim 1 wherein said shell includes a phosphorescent material.

15. The paintball of claim 1 wherein said aqueous material is biodegradable.

16. A method for fabricating a plurality of paintballs simultaneously, said method comprising the steps of:

providing a first heated, horizontally disposed vacuum thermoforming mold, said first thermoforming mold having a plurality of recesses therein;

providing a second heated horizontall disposed vacuum thermoforming mold said second thermoforming mold having a plurality of recesses therein, said recesses of said first and second thermoforming molds having the same dimensions and configurations, said second thermoforming mold being disposed relatively close to but separate from said first thermoforming mold;

feeding a polymer sheet material onto said first and second thermoforming molds;

fabricating a plurality of relatively rigid half shells with central recesses in said polymer sheet material on said first and second thermoforming molds to ultimately form first and second webs of half shells disposed upon said first and second thermoforming molds;

disposing an aqueous material having a thixotropic thickening agent in said recesses in said half shells of said first and second webs, said aqueous material being disposed in said half shells at a rate that results in said aqueous material being in a relatively liquid state to promote the self-leveling of the aqueous material in said recesses such that the recesses are completely filled without said aqueous material engaging a sealing surface of said first and second webs to promote the ultimate bonding of a sealing surface of said first web to a corresponding sealing surface of said second web;

allowing said aqueous material in said recesses in said half shells of said first and second webs to gel, said gel maintaining the position and configuration of said aqueous material in said recesses of said first and second webs irrespective of the position of said first and second webs;

removing said first and second webs of half shells from said respective first and second molds;

inverting said second web above said first web such that said half shells of said second web with said gelled aqueous material therein are oppositely disposed from and aligned with corresponding half shells of said first web with said gelled aqueous material therein, said gelled aqueous material in said recesses of said half-shells of said second web maintaining a pre-inverting position and configuration irrespective of the inverted position of said second web;

joining said second web of half shells to said first web of half shells with said gelled aqueous material disposed in said central recesses of said half shells of said first and second webs such that a paintball web containing a plurality of paintballs filled with said gelled aqueous material is formed; and removing said paintballs from said paintball web, whereby a plurality of paintballs are fabricated that ultimately engage a target, whereupon, said paintballs forcibly rupture thereby promoting a flowing substantially liquid aqueous material upon the target.

17. The method of claim 16 wherein the step of joining said second web of half-shells to said first web of half-shells includes the step of heating sealing surfaces of said first and second webs to sealing temperatures.

18. The method of claim 16 wherein the step of joining said second web of half-shells to said first web of half-shells includes the step of heating sealing surfaces of said first and second webs via ultrasonic welding.

19. The method of claim 16 wherein the step of disposing an aqueous material in said recesses, includes the step of disposing said aqueous material in said recesses without providing a barrier to seal said aqueous material in said recesses.

20. The method of claim 16 wherein the step of joining said second web of half-shells to said first web of half-shells includes the step of heating cooperating surfaces of said first and second webs via radio frequency welding.

21. The method of claim 16 wherein the step of joining said second web of half-shells to said first web of half-shells includes the step of applying an adhesive to cooperating surfaces of said first and second webs.

22. A method for fabricating a paintball, said method comprising the steps of:

forming first and second separated hemispheric half-shells with central recesses in a planar equator portion;

filling said central recesses with an aqueous material having a thixotropic thickening agent, said aqueous material being disposed in said half-shells at a rate that results in said aqueous material being in a relatively liquid state to promote the self-leveling of the aqueous material in said recesses such that the recesses are completely filled without said aqueous material engaging a sealing surface of said first and second hemispheric half-shells;

allowing said aqueous material to gel;

inverting said first hemispheric half-shell above said second hemispheric half-shell such that said first and second hemispheric half-shells with said aqueous material therein are oppositely disposed and aligned such that the planar equators portions are adjacently disposed, said aqueous material being a gel that maintains position and configuration in said recesses of said first and second hemispheric half-shells irrespective of the positioning of said first and second hemispheric half-shells; and joining said first and second hemispheric half-shells with said gelled aqueous material disposed in said central recesses of said half-shells such that a paintball is formed, whereby a paintball is fabricated that ultimately engages a target, whereupon, said paintball forcibly ruptures resulting in a substantially liquid aqueous material that marks the target.

23. The method of claim 22 wherein the step of joining said first and second hemispheric half-shells includes the step of sealing a seam about engaged equator portions of said first and second hemispheric half-shells via ultrasonic welding.

24. The method of claim 22 wherein the step of joining said first and second hemispheric half-shells, includes the step of sealing a seam about engaged equator portions of said first and second hemispheric half-shells via radio frequency sealing.

25. The method of claim 22 wherein the step of filling said central recesses with an aqueous material includes the step of filling said central recesses with an aqueous material without providing a barrier to seal said aqueous material in said central recesses.

* * * * *